US010094065B2

(12) United States Patent
Kim et al.

(10) Patent No.: US 10,094,065 B2
(45) Date of Patent: Oct. 9, 2018

(54) WASHER DRYER AND METHOD FOR CONTROLLING THE SAME

(71) Applicant: SAMSUNG ELECTRONICS CO., LTD., Suwon-si, Gyeonggi-do (KR)

(72) Inventors: Do Haeng Kim, Suwon-si (KR); Geun Kang, Hwaseong-si (KR); Hyung Sub Lim, Suwon-si (KR)

(73) Assignee: SAMSUNG ELECTRONIC CO., LTD., Suwon-si (KR)

( * ) Notice: Subject to any disclaimer, the term of this patent is extended or adjusted under 35 U.S.C. 154(b) by 820 days.

(21) Appl. No.: 14/584,677

(22) Filed: Dec. 29, 2014

(65) Prior Publication Data

US 2015/0191863 A1 Jul. 9, 2015

(30) Foreign Application Priority Data

Jan. 6, 2014 (KR) ..... 10-2014-0001252

(51) Int. Cl.
*D06F 58/10* (2006.01)
*D06F 58/04* (2006.01)
(Continued)

(52) U.S. Cl.
CPC ..... *D06F 58/10* (2013.01); *D06F 58/04* (2013.01); *D06F 58/20* (2013.01); *D06F 58/28* (2013.01);
(Continued)

(58) Field of Classification Search
CPC ..... F26B 21/00; D06F 58/10; D06F 58/04; D06F 58/20; D06F 58/28; D06F 2058/2864
(Continued)

(56) References Cited

U.S. PATENT DOCUMENTS 2,742,708 A * 4/1956 McCormick ..... D06F 58/02 34/60
3,100,387 A * 8/1963 Hubbard ..... D06F 23/02 210/145
(Continued)

FOREIGN PATENT DOCUMENTS

DE 3017089 11/1981
DE 20 2006 018 205 U1 3/2007
(Continued)

OTHER PUBLICATIONS

European Office Action dated Jun. 17, 2016 from European Patent Application No. 14200662.6, 7 pages.
(Continued)

*Primary Examiner* — Stephen M Gravini
(74) *Attorney, Agent, or Firm* — Staas & Halsey LLP

(57) ABSTRACT

A washer dryer and method for controlling the same may improve a structure of air circulation and increase dehumidification efficiency, thereby reducing drying time. A cooler fan is operated to prevent overheating of a washer dryer in the drying course, which reduces faults of the washer dryer and thus reduces user inconvenience. Overheating of the washer dryer may be prevented in advance in the washing course, which maintains washing performance and prevents delay of cooling time, leading to increased drying time accuracy and thus user satisfaction. The cooler fan is disposed on the tub to vent the air in the dryer (dry air) outside the cabinet to allow high temperature and high humidity drying, thereby increasing drying performance. A hole disposed on the bottom of the dryer sucks cool air into the inside of the dryer from the outside, and air circulation rate and dehumidification efficiency may be increased.

14 Claims, 13 Drawing Sheets

(51) Int. Cl.

| | |
|---|---|
| ***D06F 58/28*** | (2006.01) |
| ***D06F 58/20*** | (2006.01) |
| *D06F 25/00* | (2006.01) |

(52) U.S. Cl.
CPC ..... *D06F 25/00* (2013.01); *D06F 2058/2858* (2013.01); *D06F 2058/2864* (2013.01)

(58) Field of Classification Search
USPC ..... 34/493, 595; 68/19, 20
See application file for complete search history.

(56) References Cited

U.S. PATENT DOCUMENTS

| | | | | |
|---|---|---|---|---|
| 3,508,340 | A * | 4/1970 | Kombol | D06G 58/28 34/553 |
| 7,526,879 | B2 * | 5/2009 | Bae | D06F 58/206 34/239 |
| 8,250,886 | B2 * | 8/2012 | Lim | D06F 37/26 68/142 |
| 8,561,320 | B2 * | 10/2013 | Geer | F26B 25/22 134/172 |
| 9,335,095 | B2 * | 5/2016 | Bison | D06F 39/12 |
| 9,695,541 | B2 * | 7/2017 | Kim | D06F 39/083 |
| 2004/0261286 | A1 | 12/2004 | Green et al. | |
| 2013/0086812 | A1 | 4/2013 | Bellinger et al. | |
| 2015/0191863 | A1 * | 7/2015 | Kim | D06G 58/28 34/493 |

FOREIGN PATENT DOCUMENTS

| | | | | |
|---|---|---|---|---|
| EP | 2 206 821 | | 7/2010 | |
| EP | 2698468 | A1 * | 2/2014 | D06F 58/22 |
| EP | 2843119 | | 3/2015 | |
| JP | 11-498 | | 1/1999 | |
| JP | 2002-355485 | | 12/2002 | |
| KR | 10-2012-0088034 | | 8/2012 | |
| WO | WO 2007/138019 | | 12/2007 | |
| WO | WO 2013/000784 | | 1/2013 | |

OTHER PUBLICATIONS

European Office Action dated Jan. 11, 2017 from European Patent Application No. 14200662.6, 6 pages.
Extended European Search Report dated Jul. 27, 2015 from European Patent Application No. 14200662.6, 9 pages.
European Office Action dated Jul. 13, 2017 from European Patent Application No. 14200662.6, 6 pages.
European Communication dated Apr. 17, 2018 in European Patent Application No. 14200662.6.

* cited by examiner

FIG. 12

| | | TEMPERATURE | RPM |
|---|---|---|---|
| DRYING COURSE | HEATED | $T1 \leq T < Ta$ | 1000 |
| | | $Ta \leq T < Tb$ | 2000 |
| | | $Tb \leq T < Tc$ | 3000 |
| | | $Tc \leq T < T2$ | 4000 |
| | OVERHEATED | $T2 \leq T$ | 5000 (Max RPM) |
| | FOR COOLING | $T3 \leq T$ | 5000 (Max RPM) |

WASHER DRYER AND METHOD FOR CONTROLLING THE SAME

CROSS-REFERENCE TO RELATED APPLICATIONS

This application claims the priority benefit under 35 U.S.C. § 119(a) of Korean patent application Serial No. 10-2014-0001252, filed in the Korean Intellectual Property Office on Jan. 6, 2014, the entire disclosure of which is incorporated herein by reference.

BACKGROUND

1. Field

The disclosure relates generally to a washer dryer and method for controlling the same, and more particularly, a washer dryer and method for controlling the same that improves drying performance in the condition of high temperature and high humidity.

2. Description of the Related Art

Dryers dry laundry by blowing high temperature air (hot air) heated by a drying heater while rotating a drum that contains clothes or other objects (hereinafter referred to as 'laundry') that require drying. These days, washing machines equipped with such dryers (hereinafter, referred to as washer dryers) are on the market, which dries the laundry in a separate drying course, or in a drying course after completion of washing and spin-drying courses.

In general, the washer dryer may be categorized largely into a vented dryer that vents hot and humid air passed through the drum to the outside of the dryer and a condenser dryer that removes humidity from hot and humid air passed through the drum and forces the dried air to be circulated again in the drum.

The condenser dryer generally includes a drying system for dehumidification using a condensing duct and water, which requires more consumption power, more water usage, and more drying time because of very low dehumidification efficiency due to a limited area of the condensing duct.

In contrast, the vented dryer dehumidifies by circulating air in the dryer, which requires low power consumption, no water usage, and short drying time as compared with the condenser dryer. However, it requires a venting hose, and if the venting hose becomes stuffed (blocked), drying performance of the vented dryer could be degraded.

The above information is presented as background information only to assist with an understanding of the disclosure. No determination has been made, and no assertion is made, as to whether any of the above might be applicable as prior art with regard to the disclosure.

SUMMARY

Additional aspects and/or advantages will be set forth in part in the description which follows and, in part, will be apparent from the description, or may be learned by practice of the disclosure.

Embodiments of the disclosure provide a washer dryer and method for controlling the same to improve a structure of air circulation as well as to improve drying performance using high humidity drying with a cooler fan.

In accordance with an aspect of the disclosure, a washer dryer is provided. The washer dryer may include a cabinet, a tub installed in the cabinet, a drum installed in the tub in a rotatable form for accommodating laundry, a dryer installed on top of the tub for heating and circulating air exhausted from the tub to dry the laundry, and a cooler installed close to the dryer for cooling down air in the cabinet to control temperature rise of the dryer.

The dryer may include a heater and blower fan for producing hot air to dry the laundry, a drying duct for guiding the hot air into the drum, and a fluid path for circulating air exhausted from the tub to the drying duct.

The washer dryer may further include at least one or more thermostats installed in the drying duct that operate based on a temperature of the heater to control power being applied to the heater to be turned on and off.

The washer dryer may further include a first temperature sensor installed in the drying duct for detecting a temperature of the dryer.

The cooler may be installed above the tub where high temperature air is produced in the cabinet.

The cooler may include a cooler fan that operates at a control temperature of the heater to exhaust air in the cabinet to the outside.

The cooler fan may have a rotation speed (rpm) varied with the temperature detected by the first temperature sensor in a drying course of the dryer.

The cooler fan may turn on or off according to the temperature detected by the first temperature sensor in the drying course.

The cooler fan may have a rotation speed (rpm) varied with the temperature detected by the first temperature sensor for heating in the drying course.

The cooler fan may operate at a maximum speed (rpm) when overheating occurs in the drying course.

The cooler fan may operate at a maximum speed (rpm) for cooling down in the drying course.

The cooler fan may turn on or off according to the temperature detected by the first temperature sensor for cooling down in the drying course.

The washer dryer may further include a bottom hole formed on a bottom face of the cabinet, wherein the cooler fan operates to suck in air from outside the cabinet through the bottom hole and forces the air to contact a circumference area of the tub such that an inner circumference area of the tub constitutes a condensing area.

The washer dryer may further include a bottom hole formed on a bottom face of the cabinet, wherein the cooler fan operates to suck in air from outside the cabinet through the bottom hole, and forces the air to contact high temperature air produced in an upper part of the cabinet, and exhausts air in the cabinet to the outside.

The washer dryer may further include a second temperature sensor for detecting a temperature of the drum, wherein there may be at least one or more second temperature sensors installed in the drum.

In accordance with an aspect of the disclosure, a washer dryer may include a cabinet, a tub installed in the cabinet, a drum installed in the tub in a rotatable form, and a dryer for heating and circulating air exhausted from the tub. The washer dryer may include a cooler fan for exhausting air in the cabinet to the outside, a temperature sensor for detecting a temperature of the dryer, an input unit (user interface) for entering a drying command for the washer dryer, and a controller for controlling the cooler fan according to the temperature detected by the temperature sensor to cool down air in the cabinet while a drying course is in progress upon the drying command.

The cooler fan may be installed close to the dryer and have a rotation speed (rpm) varied with the temperature detected by the temperature sensor.

In accordance with an aspect of the disclosure, a method for controlling a washer dryer including a cabinet, a tub installed in the cabinet, a drum installed in the tub in a rotatable form, a dryer for heating and circulating air exhausted from the tub, and a cooler fan for exhausting air inside the cabinet to the outside is provided. The method may include determining if it is a drying course, drying laundry contained in the drum by operating the dryer if it is determined that it is the drying course, detecting a temperature of the dryer, the temperature rising while the dryer runs, and driving the cooler fan to control a rise in temperature of the dryer according to the detected temperature.

Driving the cooler fan may include driving the cooler fan to be on or off according to the temperature detected by the temperature sensor in the drying course.

Driving the cooler fan may include driving the cooler fan at a maximum rotation speed (rpm) when overheating occurs in the drying course.

Driving the cooler fan may include driving the cooler fan at a maximum rotation speed (rpm) for cooling down in the drying course.

Driving the cooler fan may include driving the cooler fan to be on or off according to the temperature detected by the temperature sensor for cooling down in the drying course.

In accordance with an aspect of the disclosure, a washer dryer may include a cabinet, a tub installed in the cabinet, a drum installed in the tub in a rotatable form, a drying duct disposed above the tub and connected at one end thereof to a front portion of the tub, to circulate air into the tub, a suction member disposed between the drying duct and the tub, and connected to a rear portion of the tub, to suck in air from the tub, and a cooler disposed in an upper portion of the washer dryer which is selectively operated according to a temperature detected in the drying duct.

The suction member may include a back member including an intake to suck in air between the tub and the cabinet, and a front member including a blower fan to circulate air between the tub and drying duct. The back member may form a first fluid path and the front member may form a second fluid path, and the intake sucks in air in a direction toward the blower fan through the first fluid path and second fluid path.

A slope of the first fluid path formed by back member may be different from a slope of the second fluid path formed by the front member.

The washer dryer may further include a first temperature sensor installed in the drying duct to detect the temperature in the drying duct, and a controller to receive the temperature in the drying duct from the first temperature sensor.

The controller, during a drying course, may control the cooler to be turned on when the temperature detected in the drying duct is equal to or greater than a first predetermined temperature.

When the temperature detected in the drying duct is equal to or greater than the first predetermined temperature, the controller may control the cooler to operate at a first setting. When the temperature detected in the drying duct cooler is equal to or greater than a second predetermined temperature, the controller may control the cooler to operate at a second setting. When the temperature detected in the drying duct cooler is equal to or greater than a third predetermined temperature, the controller may control the cooler to operate at a maximum setting.

Other aspects, advantages, and salient features of the disclosure will become apparent to those skilled in the art from the following detailed description, which, taken in conjunction with the accompanying drawings, discloses exemplary embodiments of the disclosure.

BRIEF DESCRIPTION OF THE DRAWINGS

The above and other aspects, features and advantages of certain exemplary embodiments of the disclosure will be more apparent from the following description taken in conjunction with the accompanying drawings, in which:

FIG. 12 is a table representing rotation speeds (RPM) of a cooler fan depending on temperatures in the washer dryer, according to an embodiment of the disclosure.

DETAILED DESCRIPTION

Figure 1:
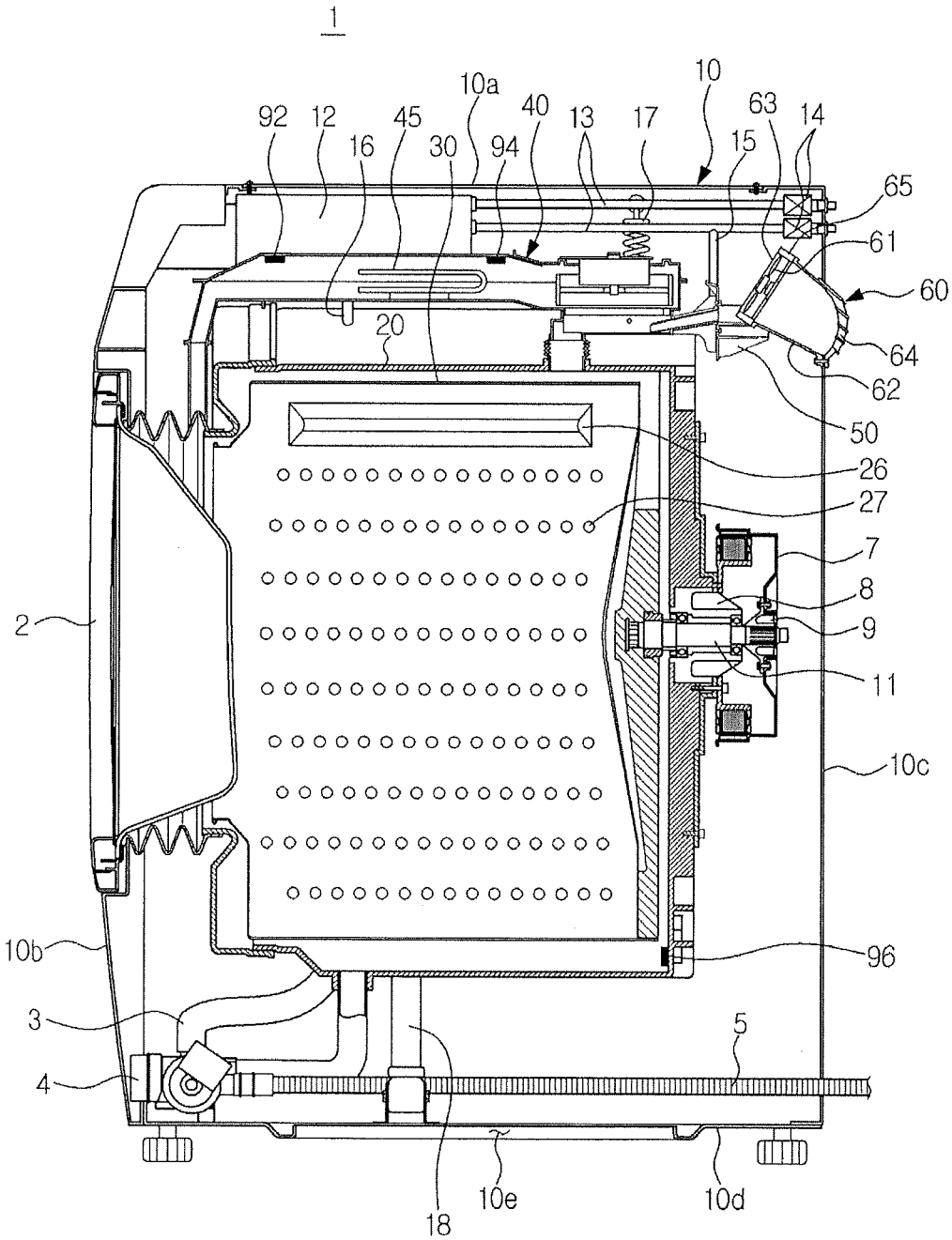
FIG. 1 is a cross sectional view of a washer dryer, according to an embodiment of the disclosure.

Reference will now be made in detail to embodiments of the disclosure, the examples of which are illustrated in the accompanying drawings, wherein like reference numerals refer to like elements, parts, components, and structures, etc, throughout. The embodiments are described below to explain the disclosure by referring to the figures.

The following description with reference to the accompanying drawings is provided to assist in a comprehensive understanding of exemplary embodiments of the disclosure as defined by the claims and their equivalents. It may include various specific details to assist in that understanding but these are to be regarded as merely exemplary. Accordingly, those of ordinary skilled in the art will recognize that various changes and modifications to the embodiments described herein may be made without departing from the scope and spirit of the disclosure. In addition, descriptions of well-known functions and constructions may be omitted for clarity and conciseness.

The terms and words used in the following description and claims are not limited to the bibliographical meanings, but, are merely used to enable a clear and consistent understanding of the disclosure. Accordingly, it should be apparent to those skilled in the art that the following description of exemplary embodiments of the disclosure is provided for illustration purposes only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" may include reference to one or more of such surfaces.

Figure 2:
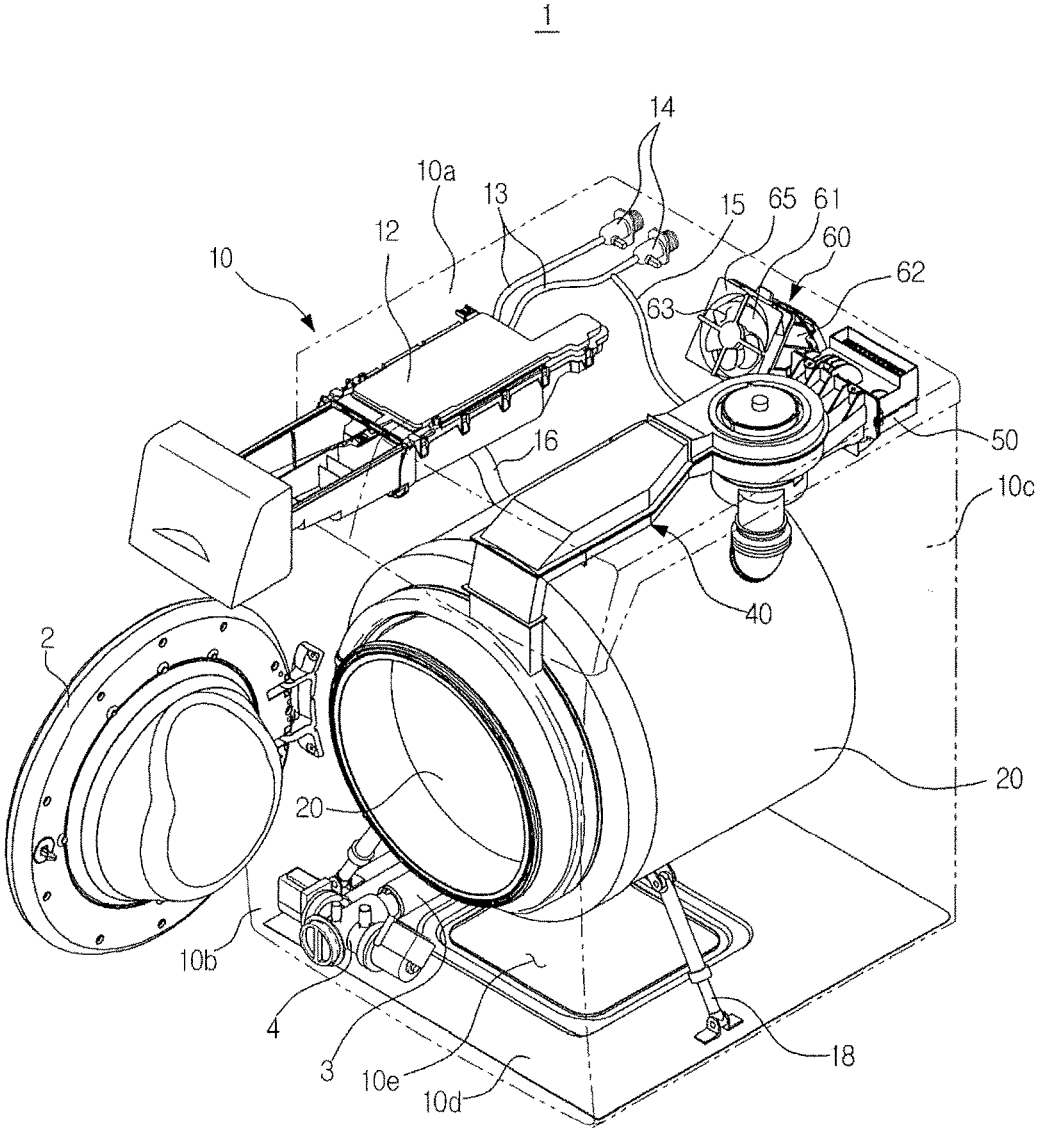
FIG. 2 is a structure of a washer dryer, according to an embodiment of the disclosure.
Figure 3:
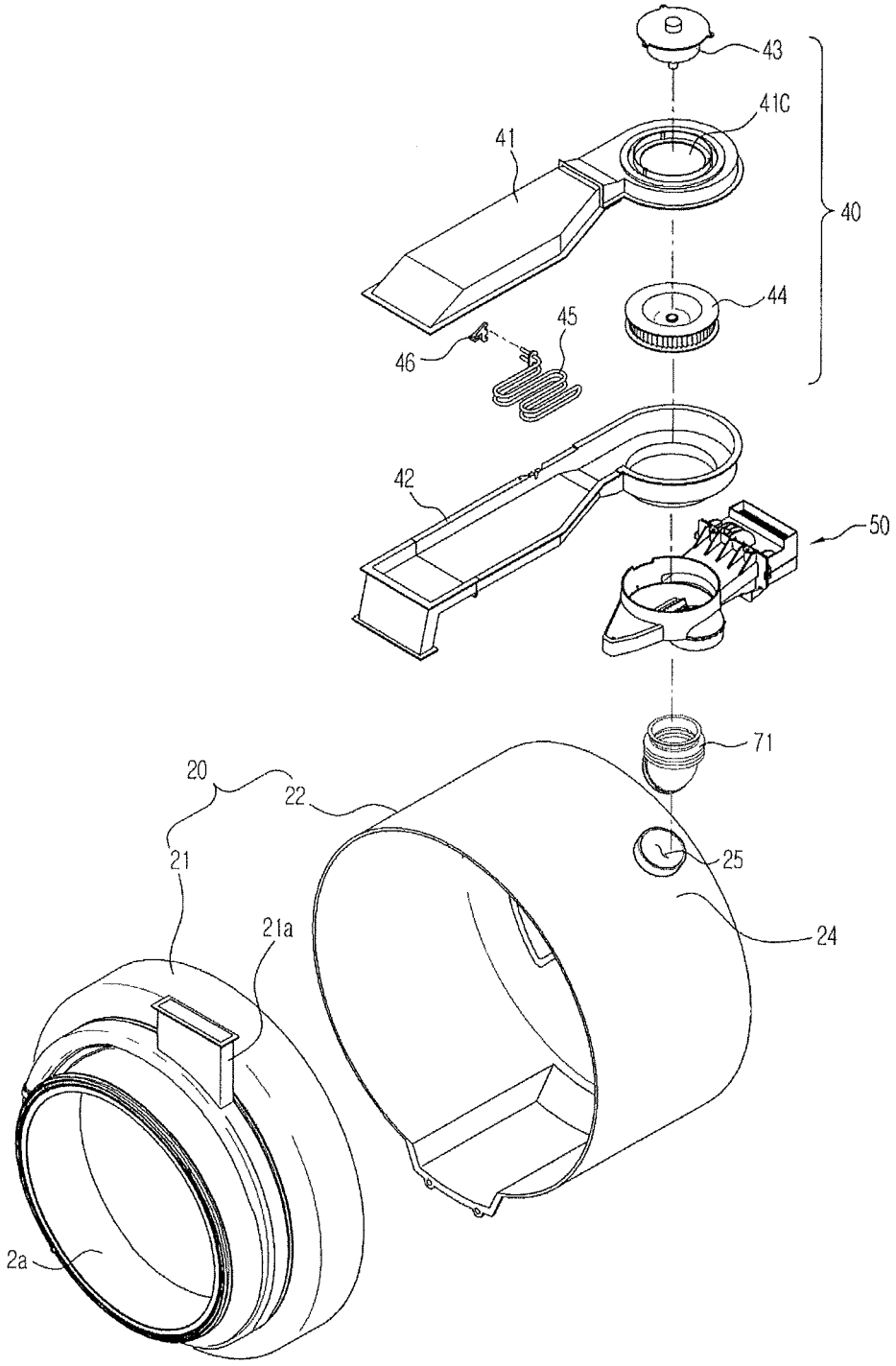
FIG. 3 is an exploded view of a washer dryer, according to an embodiment of the disclosure.

FIG. 1 is a cross sectional view of a washer dryer, according to an embodiment of the disclosure, FIG. 2 is a structure of a washer dryer, according to an embodiment of the disclosure, and FIG. 3 is an exploded view of a washer dryer, according to an embodiment of the disclosure.

Referring to FIGS. 1 to 3, a washer dryer 1 has roughly a box-like shape and may include a cabinet 10 that constitutes the appearance, a tub 20 installed in the cabinet 10, a drum 30 installed in the tub 20 in a rotatable form, and a motor 7 to rotate the drum 30.

Typically, the motor 7 may be e.g., a universal motor comprised of a field coil and an armature, or a brushless direct motor (BLDC) comprised of a permanent magnet and an electromagnet, but any type of motor may also be used as the motor 7 as long as it may be applied for a small and medium size drum. Apart from them, there may be a belt-type motor.

The tub 20 may include a first tub 21 located in the front of the inside of the cabinet 10 and a second tub 22 combined with a rear part of the first tub 21. The first tub 21 may include a cylinder unit arranged in the circumferential direction and a front plate located on the front face of the cylinder unit. The second tub 22 may include a cylinder unit arranged in the circumferential direction and a rear plate located on the back face of the cylinder unit. The cylinder units of the first and second tubs 21 and 22 may be combined to form the tub 20.

The cabinet 10 may include frames (10*a*, 10*b*, 10*c*, and 10*d*) which may include a top frame 10*a* that constitutes the top of the cabinet 10, a front frame 10*b* that constitutes the front of the cabinet 10, a back frame 10*c* that constitutes the back of the cabinet 10, and a bottom frame 10*d* that links the front and back frames 10*b* and 10*c* and constitutes the bottom of the cabinet 10.

In the front frame 10*b* of the cabinet 10, an inlet 2*a* may be formed to enable a user to put laundry into the drum 30 or pick up laundry from the drum 30. The inlet 2*a* may be opened or closed by a door 2 installed in the front frame 10*b* of the cabinet 10.

A spring 17 may be arranged between the tub 20 and the cabinet 10 to support the tub 20 from the top side. The spring 17 serves to mitigate vibration and noise produced from motions of the tub 20 using the elasticity of the spring 17.

On the top of the tub 20, there may be a water supply tube 13 for supplying water (washing water or rinsing water) into the tub 20. One end of the water supply tube 13 may be connected to an external water supply source (not shown) and the other end of the water supply tube 13 is connected to a detergent drawer 12.

The water supply tube 13 may also be connected to a sub water supply tube 15 connected to a suction member 50 as will be described later. For example, the water supply tube 13 may be connected to the sub water supply tube 15 at the end of the water supply tube 13 connected to the external water supply source. For example, the water supply tube 13 may be connected to the sub water supply tube 15 at a point which is closer to the water supply valve 14 than to detergent drawer 12.

The detergent drawer 12 may be connected to the tub 20 through a connection tube 16. Water supplied through the water supply tube 13 passes through the detergent drawer 12 and may be supplied into the tub 20 together with the detergent. A water supply valve 14 may be installed in the water supply tube 13 to control water supply.

In accordance with an embodiment, the detergent drawer 12 may be connected to the tub 20 through the connection tube 16, because the detergent drawer 12 is located in front of the inside of the cabinet 10.

The tub 20 may be supported by a damper 18. The damper 18 connects the bottom face of the cabinet 10 to the exterior of the tub 20. Aside from the internal bottom of the cabinet 10, the damper 18 may alternatively or additionally be located on the top, left and/or right of the cabinet 10 to support the tub 20. The damper 18 or the spring 17 located below or above the tub 20 may mitigate vibration and shock generated from up and down movements of the tub 20.

The back of the drum 30 may be coupled with a drive shaft 11 for transmitting power from the motor 7. A plurality of through holes 27 for water circulation may be formed in the circumference of the drum 30. On the inside circumference of the drum 30, a plurality of lifters 26 may be installed to enable laundry to rise and fall while the drum 30 is rotating.

The drive shaft 11 may be arranged between the drum 30 and the motor 7. One end of the drive shaft 11 may be coupled with the back plate of the drum 30, and the other end of the drive shaft 11 may extend to the outside of the back wall of the tub 20. When the motor 7 drives the drive shaft 11, the drum 30 coupled with the drive shaft 11 may rotate around the drive shaft 11.

On the back plate of a second tub 22, a bearing housing 8 may be installed to rotatably support the drive shaft 11. The bearing housing 8 may be made of an aluminum alloy and may be inserted to the back wall of the second tub 22 during injection molding of the second tub 22. Bearings 9 may be installed between the bearing housing 8 and the drive shaft 11 to enable the drive shaft 11 to rotate smoothly.

Under the tub 20, installed may be a drain pump 4 to drain the water in the tub 20 to the outside of the cabinet 10, a connection hose 3 to connect the tub 20 and drain pump 4 for the water in the tub 20 to be flown into the drain pump 4, and a drain hose 5 to guide the water pumped by the drain pump 4 to the outside of the cabinet 10.

Further, in the lower part of the rear side of the tub 20, a second temperature sensor 96 may be installed to detect the air temperature of the inside of the drum 30 in which laundry is dried and picked up. The second temperature sensor 96 may include a thermistor whose resistance changes with a change in temperature, and there may be one or more thermistors installed within the tub 20.

In the tub 20, a dryer may be installed for drying hot and humid air in the tub 20 and then supplying the dried air back into the tub 20. The dryer serves to remove moisture of the air condensed in the tub 20.

In accordance with an embodiment of the disclosure, the dryer may include the tub 20 for condensing moisture of air and a drying duct 40 for heating the condensed air and supplying it into the drum 30. The dryer heats and circulates the air in the tub 20 to dry the laundry in the drum 30. Accordingly, the dryer makes the air circulate in the tub 20 and the drying duct 40.

Figure 11:
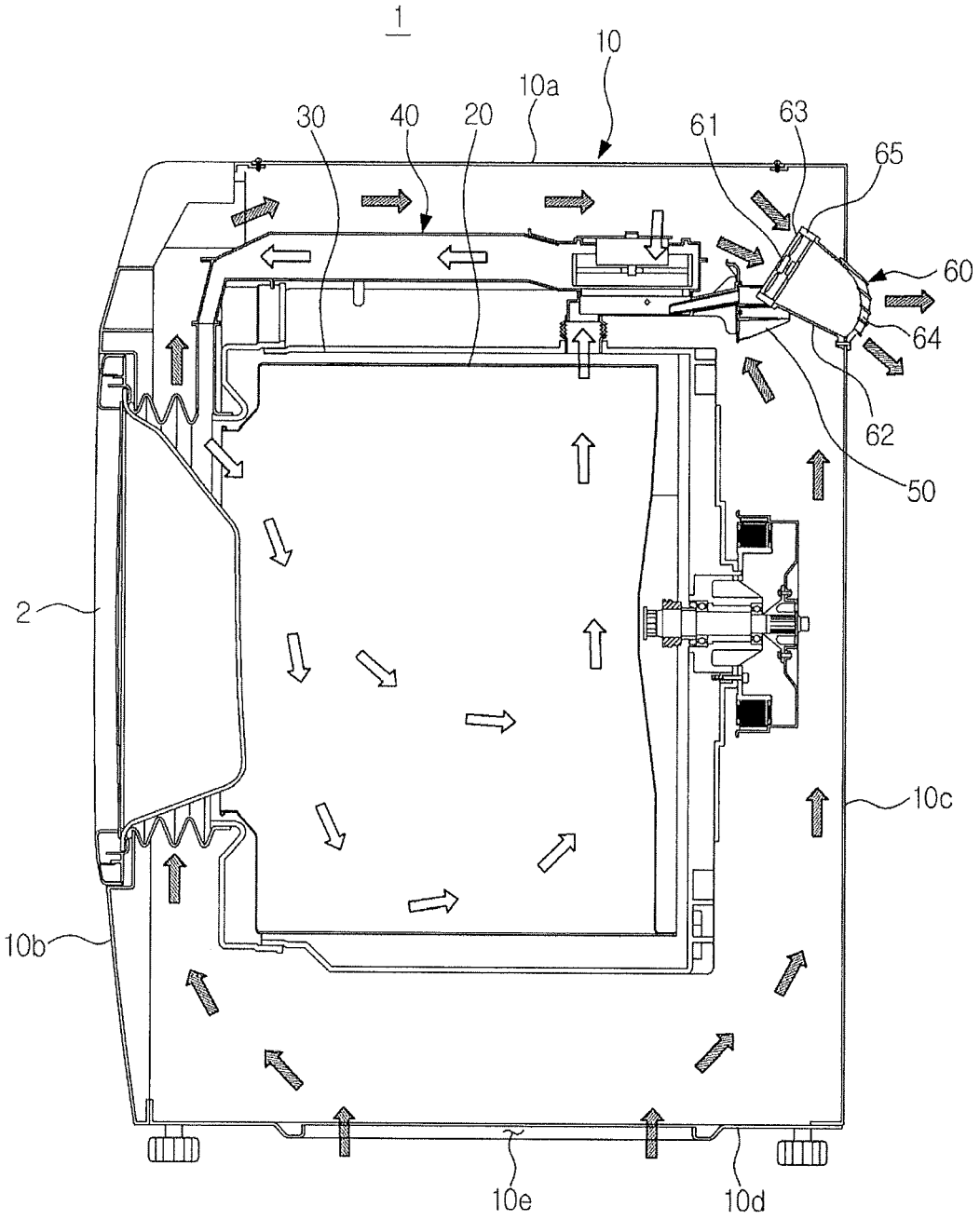
FIG. 11 illustrates air flow for cooling in a washer dryer, according to an embodiment of the disclosure.

The drying duct may be combined with the second tub 22. A connection member 71 may be arranged between the second tub 22 and the drying duct 40 to combine one end of the drying duct 40 with one end of the second tub 22. In other words, the connection member 71 may be located between an end of the drying duct 40 into which air flows and an end of the tub 20 from which the air flows. For example, as shown in FIGS. 3, 11 and 12, air flows out of an outlet 25 formed on an outer circumferential surface 24 of the second tub 22, the outlet 25 being connected to one end of the connection member 71. The air flows out of the second tub 22 and through the connection member 71 into drying duct 50, which is connected to the other end of the connection member 71.

A blower fan 44 may also be located between the drying duct 40 and the tub 20 to cause or force air circulation such that air flows from the tub 20 into the drying duct 40 and back into the tub 20. The drying duct 40 may contain a heater 45 for heating the air in the drying duct 40. A bracket 46 may be arranged to combine the heater 45 with the drying duct 40.

The heater 45 may be formed to have a predetermined diameter and length. The heater 45 may be made in a zigzag or serpentine form. The heater 45 may include a terminal unit coupled with conducting wires, a sealing member arranged some distance apart from the terminals for preventing air leakage, and a heating unit arranged by extending from the terminal unit. The heating unit may be formed by being bent several times with a predetermined diameter and length.

To secure the heater 45 in the drying duct 40, the bracket 46 may be combined with the exterior of top and bottom plates 41 and 42. Part of the terminal unit may be located on the exterior of the top and bottom plates 41 and 42 and the sealing member may be placed in the rear part of the top and bottom plates 41 and 42. The bracket 46 may be combined with the exterior of the drying duct 40 such that the bracket 46 may be inserted into the terminal unit.

The bracket 46 may be formed of an insulating material. Conducting materials may not be used for the bracket 46 to prevent overheating due to heat transmission from the heater 45. To endure the heat produced by the heater 45, materials with high thermal endurance may be used for the bracket 46. In accordance with an embodiment, polyphenylene sulfide (PPS) and polyethylene terephtalate (PET) which may be considered as having high thermal endurance may be used for the bracket 46.

Furthermore, in the drying duct 40, there may be included a first temperature sensor 92 for detecting temperature of the air passed through the heater 45, and a thermostat 94 for controlling the application of power to the heater 45 so that the heater 45 may be turned on and off, for example, according to the temperature of the heater 45.

The first temperature sensor 92 may include one or more thermistors whose resistance changes with a change in temperature, and may be installed on one side of the drying duct 40.

One or more thermostats 94 may be installed on the other side of the drying duct 40.

The drying duct 40 may include top and bottom plates 41 and 42. Also, a head 43 may be arranged above the blower fan 44.

Under the drying duct 40, the suction member 50 into which the blower fan 44 is rested may be arranged. The suction member 50 will be described in more detail later with reference to FIGS. 4 to 7.

One side of the drying duct 40 may be combined with the front panel 21*a* that extends from one side of the first tub 21. Accordingly, air circulates between the tub 20 and the drying duct 40. For example, one end of the drying duct 40 may correspond to one end of the top plate 41 and bottom plate 42. The other end of the top plate 41 and the bottom plate 42 may correspond to the side of the drying duct 40 at which the blower fan 44 may be arranged. The head 43 may be arranged or disposed to cover a central hollow portion 41*c* of the top plate 41 at the end of the top plate 41 which corresponds to the side of the drying duct 40 at which the blower fan 44 may be arranged.

In a drying course, when the drum 30 rotates and the blower fan 44 runs, air in the tub 20 flows into the drying duct 40. The air circulation between the tub 20 and the drying duct 40 may be made by repeating the process of having the air heated in the drying duct 40 flow back into the tub 20.

During this drying course, an internal temperature of the cabinet 10 may rise. A cooler 60 may be installed in the back frame 10*c* above the tub 20 where hot air usually stays. Furthermore, a floor hole 10*e* may be formed on the bottom frame 10*d* that constitutes the bottom (floor) of the cabinet 10, the floor hole 10*e* sucking in low temperature air from the outside of the washer dryer 1.

The cooler 60 may be installed near the dryer and may include a cooler fan 61 for releasing the air in the cabinet 10 to the outside, a guide member 62 for guiding the flow of air coming in while the cooler fan 61 runs, and a fan case 65 for fixing the cooler fan 61.

In the front of the cooler fan 61, an air inlet 63 for sucking in hot air in the cabinet 10 may be formed. In the back of the fan case 62 for fixing the cooler fan 61, an air outlet 64 for releasing the air sucked in by the air inlet 63 to the outside may be formed.

Accordingly, in the drying course, as the temperature in the cabinet 10 rises, the cooler fan 61 may be driven at a fan control temperature and may release the air in the cabinet 10 to the outside. This may cool down the inside of the cabinet 10.

This will be described in more detail as follows.

While the cooler fan 61 is running, low temperature air outside the cabinet 10 may be sucked into the cabinet 10 through the floor hole 10*e* formed on the bottom of the cabinet 10, and the low temperature air sucked in moves upward in the cabinet 10 and may be mixed with high temperature air in the upper part in the cabinet 10, thus dropping the air temperature in the cabinet 10 in the first place (initially). After this, the air temperature in the cabinet 10 may be further dropped by exhausting the high temperature air (dry air) in the cabinet 10 to the outside of the cabinet 10 using the cooler fan 61. Accordingly, the tub 20 enables improvement of condensing efficiency and cooling implementation.

Driving the cooler fan 61 may also help reduction in the likelihood of system failure and user inconvenience by preventing overheating of the washer dryer in 1 in the drying course.

It may also help maintain washing performance by preventing driving factor control due to the overheating of the washer dryer in 1 in the washing course.

In addition, driving the cooler fan 61 may help prevent cooling time from being delayed, leading to increased drying time accuracy and efficiency and thus increased user satisfaction.

Figure 4:
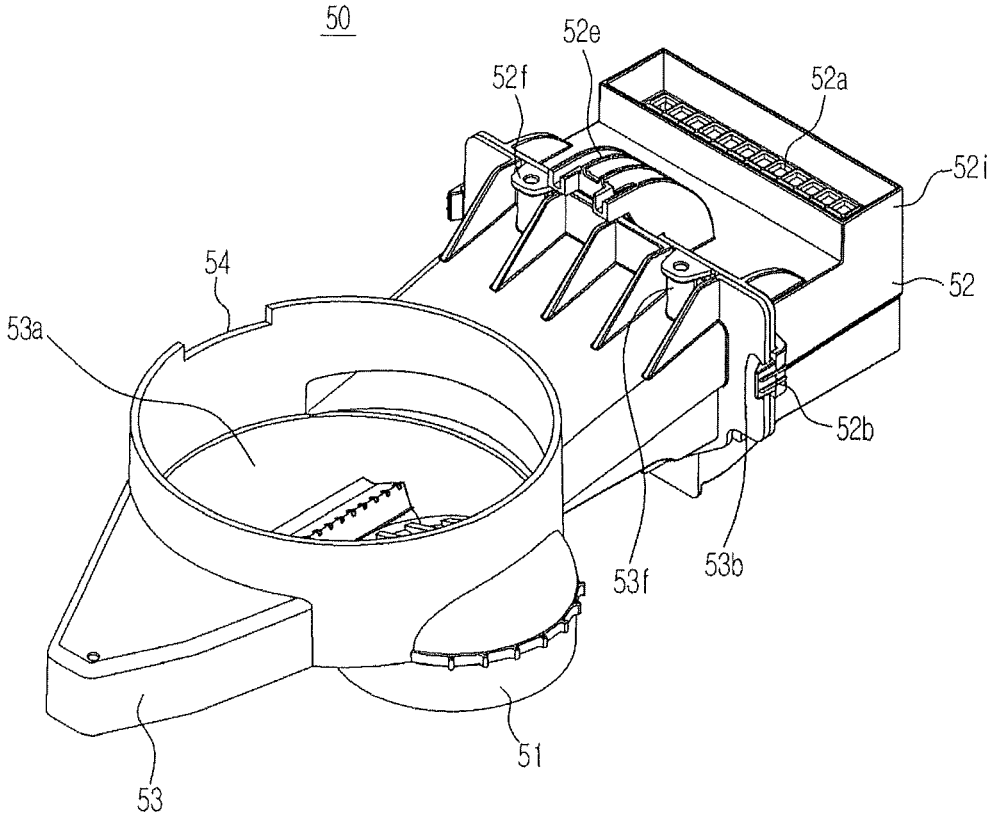
FIG. 4 illustrates a suction member, according to an embodiment of the disclosure.
Figure 5:
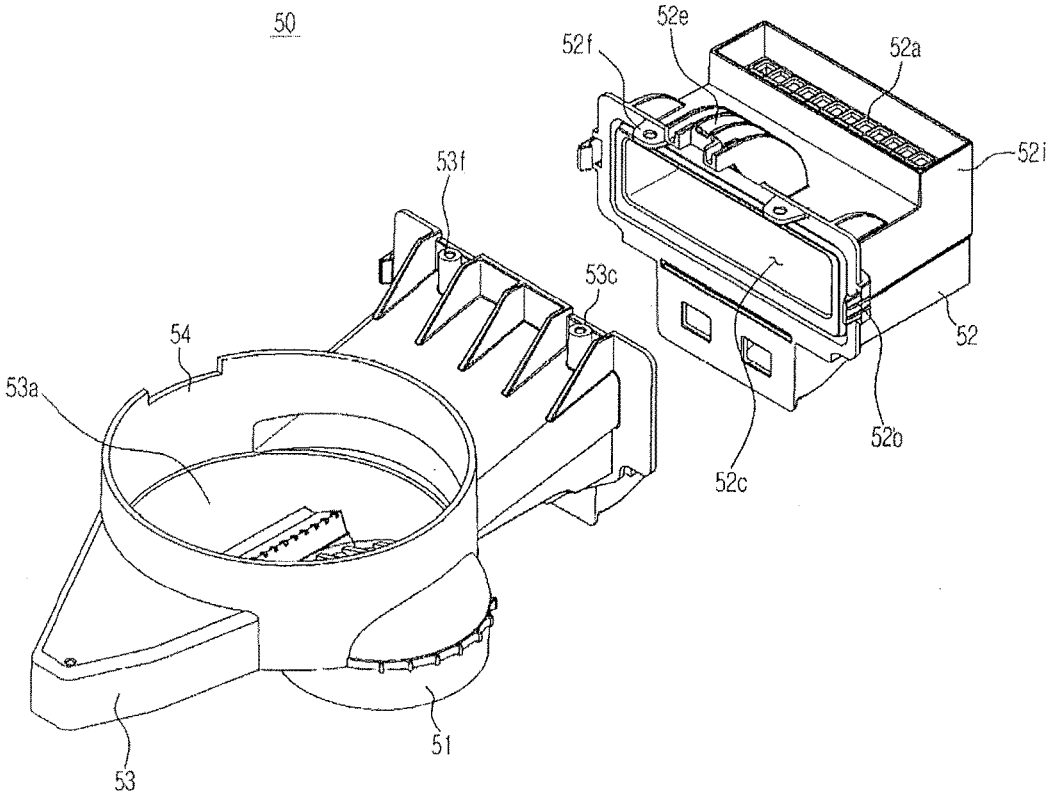
FIG. 5 is an exploded view of a suction member, according to an embodiment of the disclosure.
Figure 6:
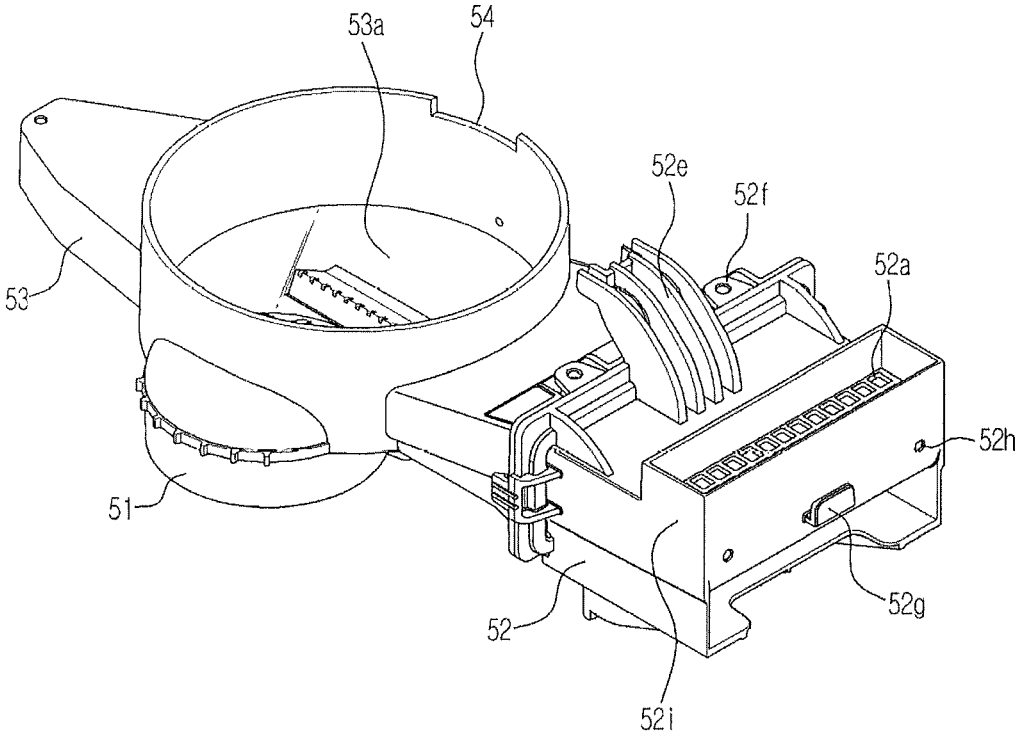
FIG. 6 illustrates the suction member viewed from a different angle, according to an embodiment of the disclosure.
Figure 7:
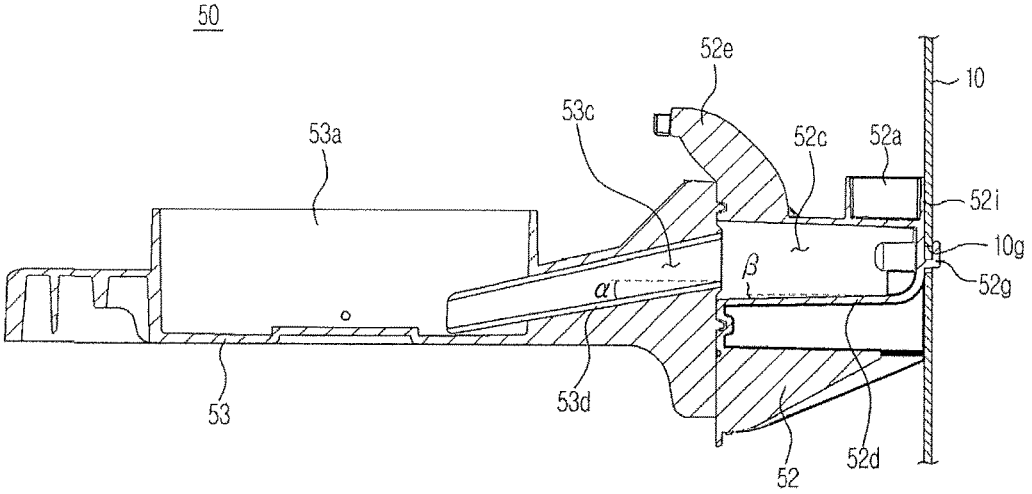
FIG. 7 is a cross sectional view of a suction member, according to an embodiment of the disclosure.

FIG. 4 illustrates a suction member, according to an embodiment of the disclosure. FIG. 5 is an exploded view of the suction member, according to an embodiment of the disclosure. FIG. 6 illustrates the suction member viewed from a different angle, according to an embodiment of the disclosure. FIG. 7 is a cross sectional view of the suction member, according to an embodiment of the disclosure.

Referring to FIGS. 4 to 7, the suction member 50 may have a fluid path through which to suck in the air between the tub 20 and the cabinet 10. The suction member 50 may include a front member 53 located in the front and a back member 52 located in the back.

The front member 53 may have a resting unit 53*a* into which the blower fan 44 rests or is disposed. The resting unit 53*a* may be piped with the tub 20, and air condensed in the tub 20 may move to the resting unit 53*a* while the cooler fan 44 runs. A slit 54, a fluid path to suck in air from outside the tub 20, may be formed on at least a part of the front member 53. In the lower part of the front member 53, a front member pipe 51 to be piped with the tub 20 may be formed.

In the back member 52, an intake 52*a* may be formed to suck in air between the tub 20 and the cabinet 10. As shown in FIGS. 4 to 7, the intake 52*a* may be formed on the top of the back member 52 in order to efficiently suck in air in the direction toward the blower fan 44. Furthermore, since the intake 52*a* may be formed on the top of the back member 52, only air exclusive of bubbles may be sucked in. The intake 52*a* may be arranged in a protruding part 52*i* that protrudes upward from the back member 52, (e.g., in a stepped fashion) in order to prevent bubbles or washing water from overflowing through the intake 52*a*. On the top of the back member 52, a support 52*e* may be formed to support the drying duct 40 against the suction member 50. The support 52*e* may protrude upward to support the top face of the drying duct 40. As shown in FIG. 4, the support 52*e* may extend upward from a central lower portion of the back member 52.

The front member 53 and the back member 52 may be fastened together with at least one fastener. The at least one fastener may include first fasteners 52*b* and 53*b* to fasten the front member 53 and the back member 52. For example, one fastener 52*b* may include a hook and another fastener 53*b* may include a hook receiving groove 53*b*. While FIG. 4 illustrates that the hook 52*b* formed in the back member 52 is fastened into a hook receiving groove 53*b* formed in the front member 53, thus combining the front member 53 and the back member 52, there may be other embodiments not limited thereto. For example, an opposite arrangement may be possible, such that the hook is formed in the front member 53 and is fastened into a hook receiving groove formed in the back member 52. Also, as can be seen from FIG. 4, at least one hook and at least one receiving groove may be formed on opposite sides of the back member and front member.

Furthermore, second fasteners 52*f* and 53*f* may be formed to fasten the front member 53 and the back member 52 together with separate fastening members (not shown). Generally, fastening members may include a screw, a bolt, a pin, a rivet, an anchor, an adhesive, and the like. The second fasteners 52*f* and 53*f* may correspond to a fastening hole 52*f* formed in the back member 52 and a fastening hole 53*f* formed in the front member 53. The fastening hole 52*f* of the back member 52 may be shaped to fit the fastening hole 53*f* of the front member 53. Specifically, the fastening member (not shown) may be inserted into the fastening hole 53*f* of the front member 53 through the fastening hole 52*f* of the back member 52, thereby fastening the front member 53 and the back member 52 together. In this case, the first fasteners 52*b* and 53*b* serve to preliminarily fasten the front member 53 and the back member 52, and the second fasteners 52*f* and 53*f* serve to fasten them finally. Alternatively, the first fasteners 52*b* and 53*b* may be fasten the front member 53 and the back member 52, after the second fasteners 52*f* and 53*f* serve to fasten the front member 53 and the back member 52. As can be seen from FIG. 4, there may be a plurality of second fasteners 52*f* and 53*f*. For example, a second fastener 52*f* and second fastener 53 may be disposed on one side of the support 52*e*, and another second fastener 52*f* and second fastener 53 may be disposed on the other side of the support 52*e*. The plurality of second fasteners 52*f* and 53*f* may have the same or similar size (e.g., diameter of hole) as one another, or may be different from one another.

Fluid paths through which air inhaled through the intake 52*a* moves may be formed inside the front member 53 and the back member 52. Among the fluid paths, one fluid path formed in the back member 52 is herein referred to as a first fluid path and the other fluid path in the front member 53 is referred to as a second fluid path. The first fluid path may be defined by a back member opening 52*c* formed on the inside of the back member 52, and the second fluid path may be defined by a front member opening 53*c* formed on the inside of the front member 53. As can be seen from FIG. 5, the back member opening 52*c* and front member opening 53*c* may be substantially rectangular in shape, however other shapes may be possible and the disclosure is not so limited (e.g., circular, oval, square, etc.).

At least one of the front member 53 and back member 42 may include a slope 52*d*, 53*d*, the floor of which inclines to one side. The slope 52*d*, 53*d* may be formed to have an incline which slopes down to the blower fan 44 and thus guides the flow of air. In this regard, the slope 52*d*, 53*d* may be inclined at 1 to 20 degrees from horizontal. While FIG. 7 illustrates that the slope 53*d* formed in the front member 53 is inclined at 15 degrees ($\alpha$) from horizontal and the tilting part 52*d* formed in the back member 52 is inclined at 1 degree ($\beta$) from horizontal, other embodiments of the disclosure are not limited thereto. This inclination prevents washing water from overflowing backwards from the tub 20. For example, as shown in FIG. 7, the angle at which the front member opening 53*c* is formed ($\alpha$), is greater than the angle at which the back member opening 52*c* is formed ($\beta$).

With the fluid path formed in the suction member 50 combined with the lower part of the drying duct 40, it is possible to suck in air between the cabinet 10 and the tub 20. The air sucked in may be used to dry laundry, thus helping to reduce drying time.

In the drying course, while the blower fan 44 runs, both hot and humid air in the tub 20 and cool and less humid air in the washer dryer 1 may be sucked in through the intake 52*a* of the suction member 50, and thus air condensation is performed in the drying duct 40 in the first place (first dehumidification). The air condensed by the first dehumidification takes moisture from the laundry while passing through the heater 45 and the drum 30, and then goes through another condensation (second dehumidification) using the internal surface of the tub 20, and then circulates again repeatedly to dry the laundry.

In this drying course, with circulation of hotter and more humid air by controlling the dry control temperature to be higher using the cooler fan 61, dehumidification efficiency may be improved and condensation (second dehumidification) effect using the surface area of the tub 20 may be maximized.

A fixer may be arranged in at least a part of the back member 52 to secure the suction member 50 to the cabinet 10. The fixer may include first fixers 52*g*, 10*g* for securing the suction member 50 to the cabinet 10 by combining at least one fixer 52*g*, which may correspond to a hook formed on the rear side of the back member into another fixer 10*g*, to at least one hook receiving groove 10*g* of the cabinet 10. The fixer may alternatively or additionally also include at least one second fixer 52*h* for securing the suction member 50 to the cabinet 10 using a separate fastening member (not shown). The second fixer 52*h* may include a security hole (not shown) formed on the rear side of the cabinet 10 and the back member 50. The first fixers 52*g*, 10*g* may be prepared for preliminary fixing, and the second fixer 52*h* finally combines the cabinet 10 and the suction member 50 together with the fastening member (not shown). Alternatively, the first fixers 52*g*, 10*g* may fasten the cabinet 10 with the suction member 50, after the second fasteners second fixer 52*h* serves to fasten the cabinet 10 with the suction member 50. As can be seen from FIG. 6, there may be a plurality of second fixers. For example, a second fixer may be disposed on one side of the fixer 52*g*, and another second fixer 52*h* may be disposed on the other side of the first fixer 52*g*. The plurality of security holes corresponding to the plurality of second fixers 52*h* may have the same or similar size (e.g., diameter of hole) as one another, or may be different from one another.

Figure 8:
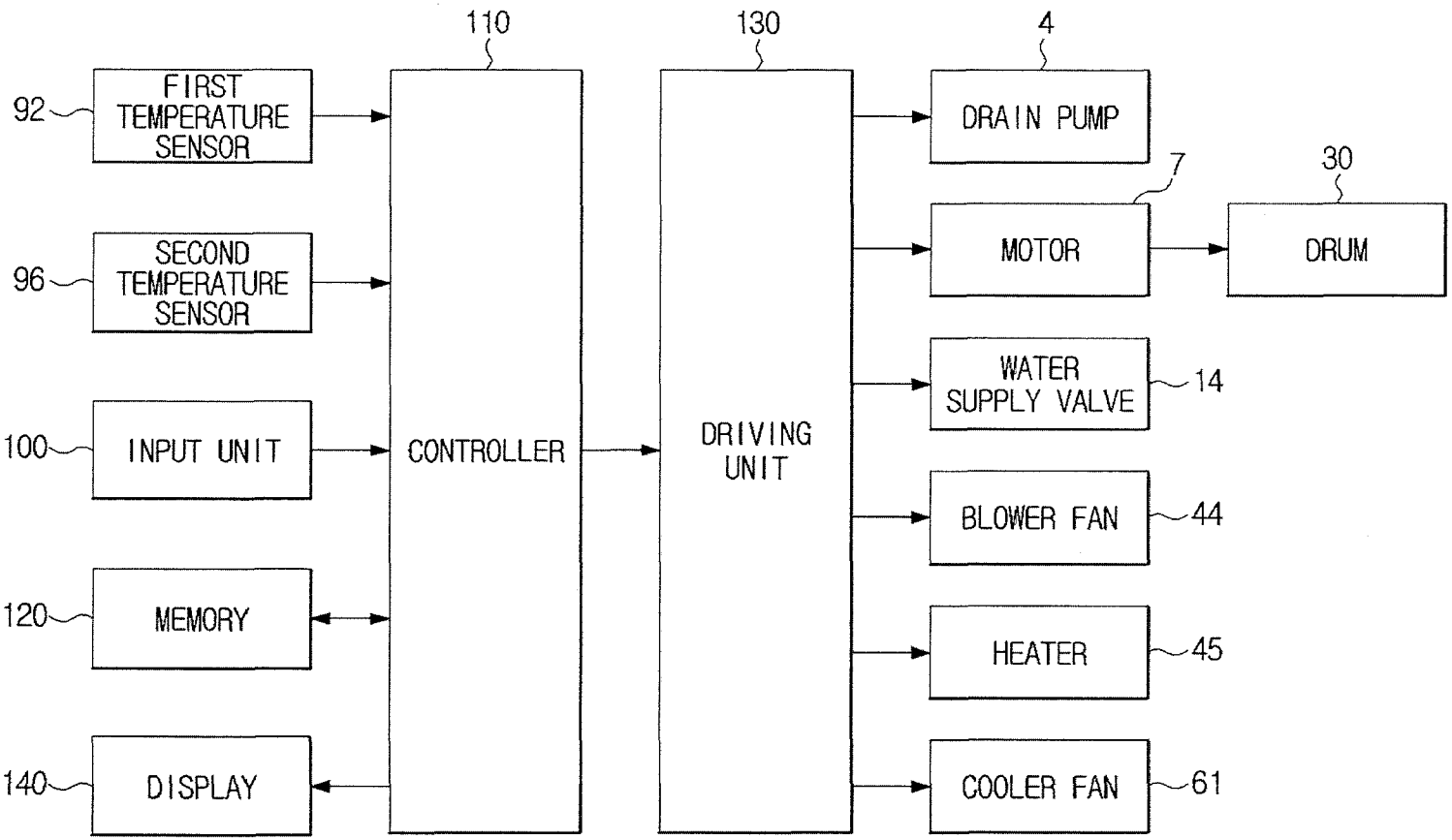
FIG. 8 is a control block diagram of a washer dryer, according to an embodiment of the disclosure.

FIG. 8 is a control block diagram of a washer dryer, according to an embodiment of the disclosure.

Referring to FIG. 8, in accordance with an embodiment of the disclosure, the washer dryer 1 may include a first temperature sensor 92, a second temperature sensor 96, an input unit 100, a controller 110, a memory 120, a driving unit (driver) 130, and a display 140.

The first temperature sensor 92 may detect a temperature of air in the drying duct 40 with the heater 45 installed therein, i.e., a temperature of air flowing into the drum 30 through the heater 45, and may send the temperature information to the controller 110.

The second temperature sensor 96 may detect a temperature of air in the drum 30 that contains laundry, i.e., a temperature at the drum's 30 exit, and may send the temperature information to the controller 110.

The input unit 100 may receive a command in response to a manual operation of the user, for the washer dryer 1 to perform a washing course, a rinsing course, a spin drying course, or a drying course.

The input unit 100 may be comprised of different kinds of buttons arranged on the control panel, and may also receive various driving information selected by the user, such as drying course selection (e.g., Normal, Towels, Perm, Delicates, etc.), drying time, start command, etc.

Apart from the buttons, the input unit 100 may also include e.g., a jog dial to select drying states (e.g., half drying, full drying, etc.) and a separate change button to control drying speed and time for the selected drying course.

Aside from them, the input unit 100 may include keys, switches, touch pads, and/or any other devices for generating input data in response to manual operations of the user, such as pushing, touching, pressing, turning, etc. Generally, the input unit 100 may correspond to a user interface which may include broadly any device a user may use to perform an operation by the washer dryer, and may include for example, one or more of a keyboard (e.g., a physical keyboard, virtual keyboard, etc.), a mouse, a joystick, a button, a switch, an electronic pen or stylus, a gesture recognition sensor (e.g., to recognize gestures of a user including movements of a body part), an input sound device or voice recognition sensor (e.g., a microphone to receive a voice command), an output sound device (e.g., a speaker), a track ball, a remote controller, a portable (e.g., a cellular or smart) phone, a tablet PC, a pedal or footswitch, a virtual-reality device, and so on. The user interface may further include a haptic device to provide haptic feedback to a user. The user interface may also include a touchscreen, for example.

The controller 110 may be a kind of micom for controlling overall operations, such as washing, rinsing, spin-drying, drying, etc., of the washer dryer 1 based on driving information input from the input unit 100, and may control a rotation speed (RPM) of the cooler fan 61 based on a temperature detected by the first temperature sensor 92 while a drying course is in progress.

The controller 110 may also control the drying course by subdividing the drying interval based on a temperature detected by the second temperature sensor 96.

Furthermore, the controller 110 may set amounts of water for washing and rinsing, spin-drying RPM, motor driving factors (motor on/off time), a time (e.g., hours and/or minutes) for washing and spin-drying, and the like, according to a laundry weight (amount of load) in the selected course. The washer dryer may include one or more processors. For example, a processing device may be implemented using one or more general-purpose or special purpose computers, and may include, for example, one or more of a processor, a controller and an arithmetic logic unit, a central processing unit (CPU), a graphics processing unit (GPU), a digital signal processor (DSP), an image processor, a microcomputer, a field programmable array, a programmable logic unit, an application-specific integrated circuit (ASIC), a microprocessor or any other device capable of responding to and executing instructions in a defined manner.

The memory 120 may store setting information, such as control data to control operations of the washer dryer 1, reference data to be used in controlling operations of the washer dryer 1, operation data generated during predetermined operations of the washer dryer 1, setting data input from the input unit 100 for the washer dryer 1 to perform a certain operation, and fault information including the number of occasions that the washer dryer 1 has performed a particular operation, usage information including e.g., model information of the washer dryer 1 and cause or position of a fault if there has been a fault in the operation of the washer dryer 1. For example, the memory or storage may be embodied as a storage medium, such as a nonvolatile memory device, such as a Read Only Memory (ROM), Programmable Read Only Memory (PROM), Erasable Programmable Read Only Memory (EPROM), and flash memory, a USB drive, a volatile memory device such as a Random Access Memory (RAM), a hard disk, floppy disks, a blue-ray disk, or optical media such as CD ROM discs and DVDs, or combinations thereof. However, examples of the storage/memory are not limited to the above description, and the storage/memory may be realized by other various devices and structures as would be understood by those skilled in the art.

The driving unit (driver) 130 may drive the drain pump 4, the motor 7, the water supply valve 14, the blower fan 44, the heater 45, the cooler fan 61, etc. associated with operations of the washer dryer 1, under control of the controller 110.

The display 140 may display the operating status of the washer dryer 1 under display control of the controller 110, together with the state of the user's manipulation by recognizing touch input through a user interface.

In case the display 140 may include a liquid crystal display (LCD) user interface (UI), it displays the operation state of the washer dryer 1 in text and thus allows the user to do a proper action for the operation state.

In case the display 140 may include a light emitting diode (LED) UI, it uses turning on or off, flickering, or difference in lighting duration, and thus may enable the user to recognize an unusual condition of the washer dryer 1. Generally, the display may include an LCD, an LED display, an organic light emitting diode (OLED) display, active matrix organic light emitting diode (AMOLED), flexible display, 3D display, a plasma display panel (PDP), a cathode ray tube (CRT) display, and the like, for example. The displays may also include touchscreen displays to enter an input. However, the disclosure is not limited to these example displays and may include other types of displays.

Embodiments of a washer dryer, method for controlling the washer dryer, and effects thereof will now be described.

Figure 9A:
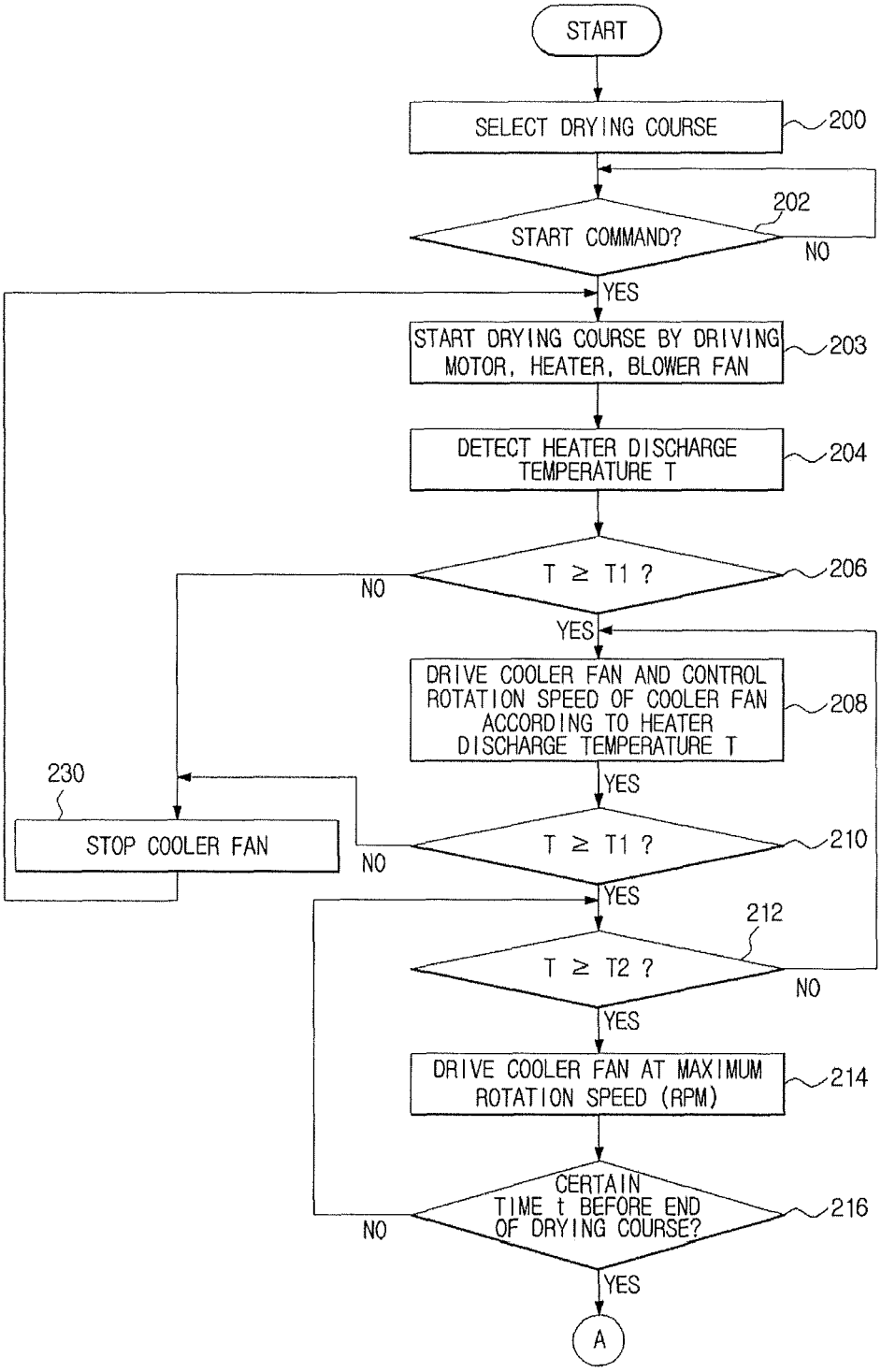
FIGS. 9A and 9B is a flowchart illustrating an algorithm for controlling a cooler fan of a washer dryer in a drying course, according to an embodiment of the disclosure.
Figure 9B:
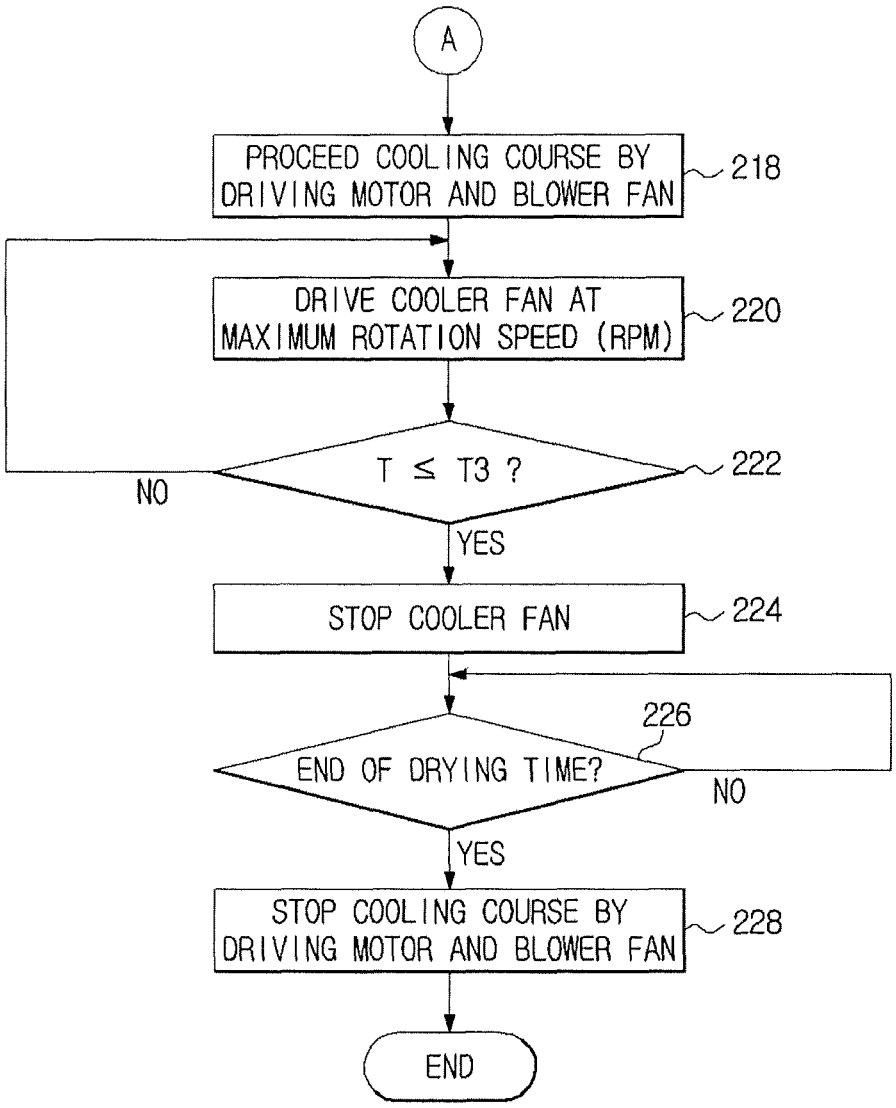
Figure 10:
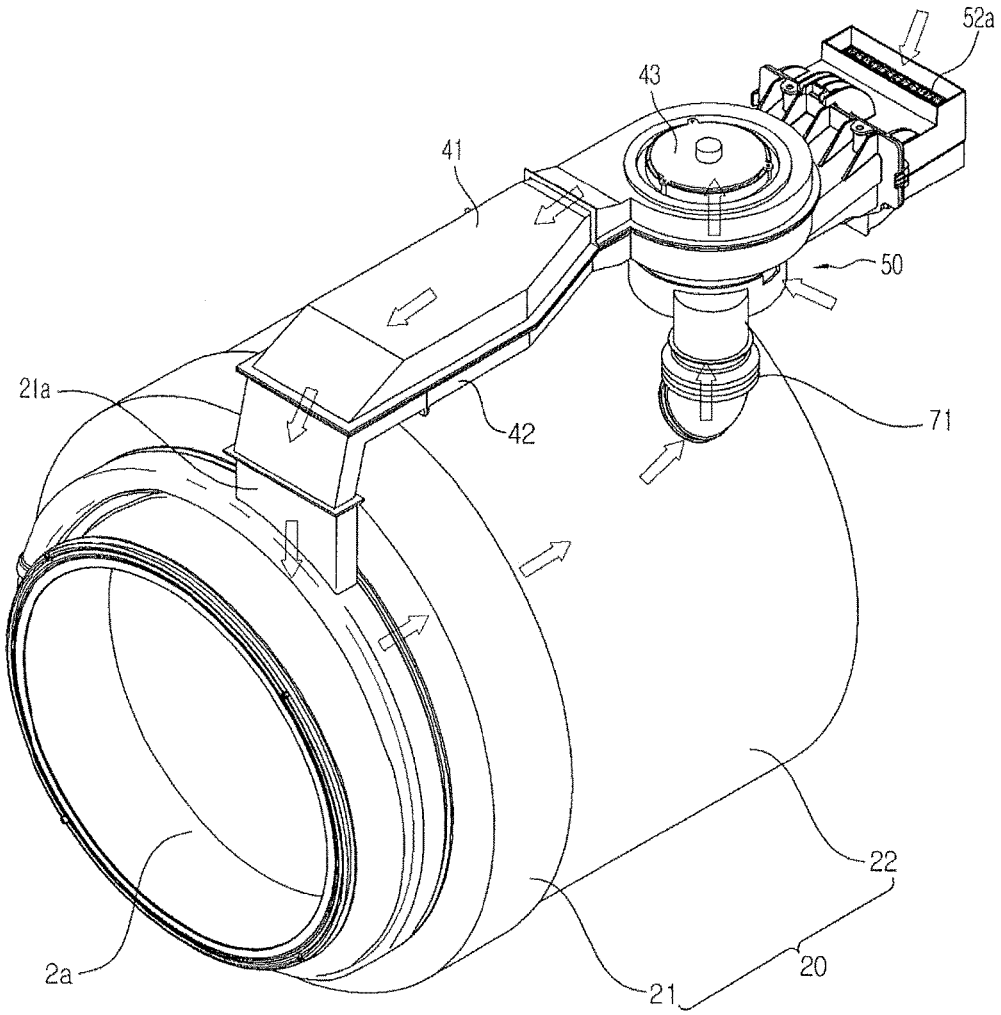
FIG. 10 illustrates air flow for drying in a washer dryer, according to an embodiment of the disclosure.

FIGS. 9A and 9B are flowcharts illustrating an algorithm for controlling a cooler fan of a washer dryer in the drying course, according to an embodiment of the disclosure, FIG. 10 illustrates air flow for drying in a washer dryer, according to an embodiment of the disclosure, FIG. 11 illustrates air flow for cooling in a washer dryer, according to an embodiment of the disclosure, and FIG. 12 is a table representing rotation speed (RPM) of a cooler fan in accordance with temperatures in the washer dryer, according to an embodiment of the disclosure.

Referring to FIGS. 9A and 9B, once the user puts some laundry to be dried into the drum 30 and selects a drying course (from among a plurality of drying courses, such as Normal, Towels, Perm, Delicates, etc.), in operation 200, information regarding the user selection is input to the controller 110 from the input unit 100.

Aside from this, the user may manipulate the input unit 100 to select a washing course that may include a drying course, depending on the laundry type. In this regard, the drying course may begin with completion of a spin-drying course associated with the washing course.

The controller 110 initiates the drying course based on course information input from the input unit 100. To do this, the controller 110 may first determine if an operation command is entered, in operation 202.

If it is determined that an operation command has been input in operation 202, the controller 110 may initiate the drying course by driving the motor 7, the blower fan 44, and the heater 45 using the driving unit 130, in operation 203.

With the start of the drying course, the motor 7 drives the drum 30 to rotate with the laundry, and the air in the drum 30 starts to move in response to the operation of the blower fan 44.

Further, the heater 45 produces high temperature air (hot air) by heating the air that moves in the drum 30, and the hot air flows into the drum 30 through the drying duct 40. The hot air coming into the drum 30 dries the laundry by contacting the laundry that rotates with the repetitive rising and falling in the drum 30 and thus evaporating moisture contained in the laundry.

The drying course in association with the blower fan 44 and the heater 45 will be described below in more detail.

In the drying course, while the blower fan 44 is running, both hot and humid air in the tub 20 and cool and less humid air in the washer dryer 1 are sucked into the drying duct 40 through the intake 52*a* of the suction member 50 (refer to FIG. 10). Accordingly, the hot and humid air and the cool and less humid air are mixed and air condensation (first dehumidification) is performed in the drying duct 40. The air condensed by the first dehumidification takes moisture from the laundry while passing through the heater 45 and the drum 30 and is then condensed inside the tub 20 using the internal surface of the tub 20 (second dehumidification). Then, with the blower fan 44 running, the drying continues by repetitive recirculation of the hot and humid air in the tub 20.

As such, if the drying course begins, the laundry in the drum 30 starts to be dried. While the drying course is in progress, a temperature of the air in the drying duct 40 with the heater 45 installed therein, i.e., a temperature of the air flown into the drum 30 through the heater 45 (hereinafter, referred to as "heater discharge temperature T") is detected by the first temperature sensor 92, which in turn sends the temperature information to the controller 110, in operation 204.

The controller 110 then compares the heater discharge temperature T detected by the first temperature sensor 92 with a pre-stored first temperature T1 (e.g., corresponding to a start temperature for cooling the inside of the washer dryer in the drying course, approximately or about 120 degrees) and determines whether the heater discharge temperature T is equal to or higher than the first temperature T1, in operation 206.

If it is determined that the heater discharge temperature T is equal to or higher than the first temperature T1 in operation 206, the controller 110 determines that the inside of the washer dryer 1 has started getting hot and controls the driving unit 130 to drive the cooler fan 61, in operation 208.

When the cooler fan 61 is driven at a rotation speed varied with the heater discharge temperature T, low temperature air outside the cabinet 10 is sucked into the cabinet 10 through the floor hole 10*e* formed on the bottom of the cabinet 10, and the low temperature air sucked in moves upward in the cabinet 10 and is mixed with high temperature air in the upper part in the cabinet 10, thus dropping the air temperature in the cabinet 10 in the first place (initially). After this, the air temperature in the cabinet 10 may be further dropped by exhausting the high temperature air (dry air) in the cabinet 10 to the outside of the cabinet 10 using the cooler fan 61 (refer to FIG. 11).

The controller 110 may control the rotation speed (RPM) of the cooler fan 61 to be within a predetermined range (e.g., a range of about 1,000 to about 4,000 RPM) according to the heater discharge temperature T, as shown in FIG. 12.

It is seen from FIG. 12 that the higher the heater discharge temperature T, the higher the rotation speed (RPM) of the cooler fan 61. This control mechanism is to quickly cool down the inside of the washer dryer 1 by increasing the rotation speed of the cooler fan 61 because the internal temperature of the washer dryer 1 rises as the heater discharge temperature rises. It may be seen from FIG. 12 there are four different temperature ranges corresponding to four different RPM values. The four different temperature ranges may have a same range magnitude (e.g., about 3 degrees each), or may have a different range magnitude (e.g., 2 degrees, three degrees, four degrees, five degrees, etc.).

The controller 110 may control the rotation speed (RPM) based on the heater discharge temperature T in a range of about 120 to about 130 degrees.

As such, the inside of the washer dryer 1 may be forced to be cooled down by driving the cooler fan 61 in the drying course, which may increase condensation efficiency using the surface of the tub 20.

In other words, in the drying course, with circulation of hotter and more humid air by controlling the dry control temperature to be higher by running the cooler fan 61, dehumidification efficiency may be improved and a condensation (second dehumidification) effect using the surface area of the tub 20 may be maximized.

Next, the controller 110 may determine once again if the heater discharge temperature T is equal to or higher than the first temperature T1 in order to check whether the heater discharge temperature T has changed while the cooler fan 61 is running, in operation 210.

If it is determined that the heater discharge temperature T is equal to or higher than the first temperature T1 in operation 210, the controller 110 may compare the heater discharge temperature T with a pre-stored second temperature T2 (e.g., a temperature for cooling the inside of the washer dryer 1 to the maximum in the drying course, approximately or about 130 degrees) and may determine if the heater discharge temperature T is equal to or higher than the second temperature T2, in operation 212.

If it is determined that the heater discharge temperature T is lower than the second temperature T2 in operation 212, the controller 110 may determine that the inside of the washer dryer 1 has not yet been overheated and then goes back to operation 208 to control the rotation speed of the cooler fan 61 to be in a predetermined range (e.g., a range of about 1,000 to about 4,000 RPM) according to the heater discharge temperature T, as shown in FIG. 12. Alternatively, if it is determined that the heater discharge temperature T is lower than the second temperature T2 in operation 212, the controller 110 may determine that the inside of the washer dryer 1 has not yet been overheated and then goes back to operation 206, where it is determined once again whether the heater discharge temperature T is equal to or higher than the first temperature T1 before proceeding to operation 208 or operation 230 based on the determination.

Otherwise, if it is determined that the heater discharge temperature T is equal to or higher than the second temperature T2 in operation 212, the controller 110 determines that the inside of the washer dryer 1 is overheated and then controls the driving unit 130 to drive the cooler fan 61 at a maximum rotation speed (about 5,000 RPM), in operation 214.

When the cooler fan 61 is driven at its maximum rotation speed, low temperature air outside the cabinet 10 is sucked into the cabinet 10 through the floor hole 10*e* formed on the bottom of the cabinet 10, and the low temperature air sucked in moves upward in the cabinet 10 and is mixed with high temperature air in the upper part in the cabinet 10, thus dropping the air temperature in the cabinet 10 in the first place (initially). After this, the air temperature in the cabinet 10 may be further dropped by exhausting the high temperature air (dry air) in the cabinet 10 to the outside of the cabinet 10 using the cooler fan 61.

As such, overheating of the washer dryer 1 may be prevented while a drying course is in progress, thereby reducing likelihood of system failure and user inconvenience.

If the heater discharge temperature T is equal to or higher than the second temperature T2, it indicates that the inside of the washer dryer 1 is overheated and may thus be in need of cooling down as soon as possible by driving the cooler fan 61 at a highest rotation speed.

The controller 110 then counts the drying time and determines whether the current count is a certain time t1 (e.g., about 5 to about 10 minutes) away from the end of the drying time, in operation 216.

This is done to cool down the inside of the washer dryer 1 by stopping the heater 45 the certain time t1 before the end of the drying time.

If it is determined that the current count is not the certain time t1 away from the end of the drying time in operation 216, the controller 110 goes back to operation 212 and follows the subsequent operations.

On the other hand, if it is determined that the current count is the certain time t1 away from the end of the drying time in operation 216, the controller 110 may control the driving unit 130 to stop the heater 45 and proceeds to perform a cooling course by driving the motor 7 and the blower fan 44, in operation 218.

The cooling course is to stop the heater 45 and periodically turn on and off the blower fan 44, in order to protect a user who may happen to open the door 2 after completion of the drying course against hot air excessively exhausted out of the door 2. The cooling course begins when the current count is the certain time t1 (about 5 to about 10 minutes) away from the end of the drying course.

The blower fan 44 may be turned on after being off for more than at least about 5 seconds, to secure a time for the blower fan 44 to be completely off. In accordance with an embodiment of the disclosure, in the cooling course, the cooler fan 44 may be set to be on for about 20 seconds and off for about 10 seconds.

In the cooling course, the controller 110 may control the driving unit 130 to drive the cooler fan 61 at a highest rotation speed (about 5,000 RPM) in order to quickly cool down the inside of the washer dryer 1, in operation 220.

When the cooler fan 61 is driven at its maximum rotation speed, low temperature air outside the cabinet 10 is sucked into the cabinet 10 through the floor hole 10*e* formed on the bottom of the cabinet 10, and the low temperature air sucked in moves upward in the cabinet 10 and is mixed with high temperature air in the upper part in the cabinet 10, thus dropping the air temperature in the cabinet 10 in the first place (initially). After this, the air temperature in the cabinet 10 may be further dropped by exhausting the high temperature air (dry air) in the cabinet 10 to the outside of the cabinet 10 using the cooler fan 61.

As such, the inside of the washer dryer 1 may be forced to be cooled down by driving the cooler fan 61 in the cooling course, which may prevent the cooling time from being delayed and thus increase accuracy of the drying time, leading to increased user satisfaction.

Next, the controller 110 may compare the heater discharge temperature T with a predetermined third temperature T3 (a temperature for moderately maintaining a surface temperature of the door 2, about 60 degrees) to check if the heater discharge temperature T has changed while the cooler fan 61 is running, and may determine whether the heater discharge temperature T is lower than the third temperature T3, in operation 222.

While the drying course is in progress, the surface temperature of the door 2 may rise as the air temperature in the drum 30 gets high. Since the rise in surface temperature of the door 2 may cause damage or harm to the user, such as burning, excessive rise in surface temperature of the door 2 should be avoided during the drying course or upon completion of the drying course. However, it is not desirable to unconditionally drop the surface temperature of the door 2 to protect the user against the burn damage, because if the temperature in the drum 30 is forced to fall in order to lower the surface temperature of the door 2, the user might have a feeling that the laundry is cold when he/she takes the laundry out such that the user may think or perceive that the drying quality is poor even though the laundry has been completely dried.

Therefore, in order to prevent harm or damage to a user while at the same also provide the user with a satisfactory feeling of drying quality by preventing a temperature drop of the laundry after drying, the surface temperature of the door 2 may be desirably maintained at a moderate temperature.

If it is determined that the heater discharge temperature T is higher than the third temperature T3 in operation 222, the controller 110 goes to operation 220 to control the driving unit 130 to drive the cooler fan 61 at the maximum rotation speed (about 5,000 RPM).

On the other hand, if it is determined that the heater discharge temperature T is equal to or lower than the third temperature T3, the controller 110 may control the driving unit 130 to stop the heater 61 and may continue the cooling course to drive the motor 7 and the blower fan 44, in operation 224.

Next, the controller 110 may determine if it is time to stop the drying course, in operation 226, and if it is time to stop the drying course, stops the cooling course by halting operations of the motor 7 and the blower fan 44 in operation 228.

On the other hand, if the heater discharge temperature T is lower than the first temperature T1 in operation 206, the controller 110 may determine that the inside of the washer dryer 1 is not sufficiently hot to drive the cooler fan 61 and thus halts the operation of the cooler fan 61, in operation 230, and then goes to operation 203 and follows the subsequent operations.

If it is determined that the heater discharge temperature T is lower than the first temperature T1 in operation 210, the controller 110 may determine that the inside of the washer dryer 1 is not sufficiently hot to drive the cooler fan 61 and goes to operation 230 to control the driving unit 130 to halt the operation of the cooler fan 61.

While in the embodiment described above, the method for cooling the inside of the washer dryer 1 by controlling the rotation speed (RPM) of the cooler fan 61 to be in a range of about 1,000 to about 4,000 RPM in order to maintain the heater discharge temperature T in a range of about 120 to about 130 degrees is employed in a drying course, the disclosure is not limited thereto and a washing course may also employ the same method in some other embodiments, achieving the same effects. In the case of the washing course, the inside of the washer dryer 1 may be cooled down by controlling the cooler fan 61 at a speed of a range of about 3,000 to about 4,000 RPM to maintain the heater discharge temperature T in a range of about 80 to about 90 degrees.

With the proposed washer dryer and method for controlling the same, a structure of air circulation may be improved, thereby increasing dehumidification efficiency and thus reducing drying time.

Further, by running the cooler fan, overheating of a washer dryer may be avoided in a drying course, which reduces likelihood of faults of the washer dryer and thus reduces user inconvenience. Additionally, operation factor control due to overheating of the washer dryer may be prevented in advance in a washing course, which maintains washing performance and prevents delay of cooling time, leading to increased drying time accuracy and thus increased user satisfaction.

Furthermore, placing the cooler fan on the tub to vent the air in the dryer (dry air) outside the cabinet allows high temperature and high humidity drying, thereby increasing drying performance.

Furthermore, by adding a hole on the bottom face of the dryer to suck cool air into the inside of the dryer from the outside, both air circulation rate and dehumidification efficiency may be increased.

In addition, by removing a space for a condensing duct, laundry capacity may be increased without increasing the cabinet, and it is economical that air condensation may be possible without water (condensate).

Each block of the flowchart illustrations may represent a unit, module, segment, or portion of code, which comprises one or more executable instructions for implementing the specified logical function(s). It should also be noted that in some alternative implementations, the functions noted in the blocks may occur out of order. For example, two blocks shown in succession may in fact be executed substantially concurrently (simultaneously) or the blocks may sometimes be executed in the reverse order, depending upon the functionality involved.

While the disclosure has been shown and described with reference to certain exemplary embodiments thereof, it will be understood by those skilled in the art that various changes in form and details may be made therein without departing from the spirit and scope of the disclosure as defined by the appended claims and their equivalents.

What is claimed is:

1. A washer dryer comprising:
a cabinet;
a tub installed in the cabinet;
a drum installed in the tub in a rotatable form;
a dryer configured to heat and circulate air along an air flow circulation path into and out of the tub; and
a cooler configured to cool down air outside the tub in the cabinet and outside the air flow circulation path to control a temperature rise of the dryer,
wherein the dryer comprises:
a heater and blower fan to produce hot air;
a drying duct to guide the hot air into the drum; and
a fluid path to circulate air exhausted from the tub to the drying duct.

2. The washer dryer of claim 1, further comprising:
at least one or more thermostats installed in the drying duct to operate based on a temperature of the heater to control power being applied to the heater to be turned on and off.

3. The washer dryer of claim 1, further comprising:
a first temperature sensor installed in the drying duct to detect a temperature of the dryer.

4. The washer dryer of claim 3, wherein the cooler is installed above the tub where high temperature air is produced in the cabinet.

5. The washer dryer of claim 3, wherein the cooler comprises a cooler fan to operate at a control temperature of the heater and to exhaust air in the cabinet to the outside.

6. The washer dryer of claim 5, wherein the cooler fan has a rotation speed (rpm) which varies with the temperature detected by the first temperature sensor in a drying course of the dryer.

7. The washer dryer of claim 6, wherein the cooler fan turns on or off according to the temperature detected by the first temperature sensor in the drying course.

8. The washer dryer of claim 6, wherein the cooler fan has a rotation speed (rpm) which varies with the temperature detected by the first temperature sensor during a heating operation in the drying course.

9. The washer dryer of claim 6, wherein the cooler fan operates at a maximum rotation speed (rpm) when overheating occurs in the drying course.

10. The washer dryer of claim 6, wherein the cooler fan operates at a maximum rotation speed (rpm) during a cooling down operation in the drying course.

11. The washer dryer of claim 6, wherein the cooler fan turns on or off according to the temperature detected by the first temperature sensor during a cooling down operation in the drying course.

12. The washer dryer of claim 5, further comprising:
a bottom hole formed on a bottom face of the cabinet,
wherein the cooler fan operates to suck in air outside the cabinet through the bottom hole and to force the air to contact a circumference area of the tub such that an inner circumference area of the tub constitutes a condensing area.

13. The washer dryer of claim 5, further comprising:

a bottom hole formed on a bottom face of the cabinet, wherein the cooler fan operates to suck in air outside the cabinet through the bottom hole, to force the air to contact high temperature air produced in an upper part of the cabinet, and to exhaust air in the cabinet to the outside.

14. The washer dryer of claim 1, further comprising:

a second temperature sensor to detect a temperature of the drum, wherein there are at least one or more second temperature sensors installed in the drum.

* * * * *